US007938298B2

(12) United States Patent
Lee

(10) Patent No.: US 7,938,298 B2
(45) Date of Patent: May 10, 2011

(54) SMALL HAND-OPERATED PUMP

(75) Inventor: Chung Kee Lee, Seoul (KR)

(73) Assignee: Chong Woo Co., Ltd. (KR)

( * ) Notice: Subject to any disclaimer, the term of this patent is extended or adjusted under 35 U.S.C. 154(b) by 952 days.

(21) Appl. No.: 11/568,236

(22) PCT Filed: Apr. 25, 2005

(86) PCT No.: PCT/KR2005/001180
§ 371 (c)(1),
(2), (4) Date: Jul. 2, 2007

(87) PCT Pub. No.: WO2005/105597
PCT Pub. Date: Nov. 10, 2005

(65) Prior Publication Data

US 2008/0035678 A1 Feb. 14, 2008

(30) Foreign Application Priority Data

Apr. 29, 2004 (KR) ..... 10-2004-0030152

(51) Int. Cl.
*B65D 47/34* (2006.01)

(52) U.S. Cl. ..... 222/321.1; 222/321.2; 222/321.9; 222/340; 222/383.3; 222/385

(58) Field of Classification Search ..... 222/320–321.2, 222/321.7–321.9, 340, 383.1, 383.3, 385
See application file for complete search history.

(56) References Cited

U.S. PATENT DOCUMENTS 6,685,062 B1 * 2/2004 Ki ..... 222/321.7
6,962,273 B2 * 11/2005 Masuda ..... 222/321.9

FOREIGN PATENT DOCUMENTS

| | | |
|---|---|---|
| JP | 2002-066401 | 3/2002 |
| KR | 20-0290778 | 9/2002 |
| KR | 10-2003-0050378 | 6/2003 |
| KR | 20-0318834 | 6/2003 |
| KR | 10-2004-0004851 | 1/2004 |

OTHER PUBLICATIONS

PCT International Search Report: International Application No. PCT/KR2005/001180, Date of Mailing: Jul. 29, 2005.
PCT Written Opinion: International Application No. PCT/KR2005/001180, Date of Mailing: Jul. 29, 2005.

* cited by examiner

*Primary Examiner* — J. Casimer Jacyna
(74) *Attorney, Agent, or Firm* — Cantor Colburn LLP

(57) ABSTRACT

A hand-operated pump that can be mounted in a cosmetic container is provided. A compression spring that provides restoring force during pumping is provided outside a housing such that it is possible to prevent contents from being contaminated and to easily pump highly viscous contents. Also, since the compression spring is stably fixed to a shaft in a state where the button is separated, it is possible to easily assemble the pump, to easily partialize parts (to modularize parts), and to prevent the pump from malfunctioning even if the button drifts away while in use. Also, since an introducing hole in the lower end of the housing is opened and closed by an opening and closing member of a specific shape, it is possible to obtain high sealing force and pumping force during pumping.

3 Claims, 9 Drawing Sheets

500

SMALL HAND-OPERATED PUMP

TECHNICAL FIELD

The present invention relates to a small hand-operated pump mounted in a cosmetic container, and more particularly, to a small hand-operated pump in which a compression spring that provides restoring force during pumping is provided outside a housing such that contents are not contaminated and such that highly viscous contents can be easily pumped, in which the compression spring is stably fixed to a shaft in a state where a button is separated such that it is possible to easily assemble the pump and to easily partialize parts (modulization) and such that malfunctioning of the hand-operated pump is prevented even if the button is separated while in use, and in which a introducing hole in the lower end of the housing is opened and closed by an opening and closing member having a specific shape such that it is possible to provide high scaling and pumping force during pumping.

BACKGROUND ART

Generally, small hand-operated pumps are used in cosmetic containers that discharge a desired amount of liquid or emulsion contented therein for their convenience. In particular, such hand-operated pumps are widely used since they allow convenient and easy discharge of the contents of a container in uniform aliquots. Technology related to the hand-operated pump has been steadily developed.

A conventional small hand-operated pump includes a housing that constitutes the external appearance of the pump, a closure used to mount the housing in a container, a stem connected to a discharge hole of a button to move vertically along the housing, a shaft for guiding the vertical movement of the stem and for connecting the stem to the button, a piston that which moves vertically along the inner wall of the housing while being mounted in the stem, a spring mounted in the lower portion of the inner wall of the housing, and a ball for opening and closing the receiving hole in the lower end of the housing.

Such a conventional hand-operated pump has some problems.

First, a compression spring that provides restoring force to the stem during pumping is provided inside the housing in the introducing passage channel of contents such that the compression spring serves as a flow resistance factor. Therefore, a highly elastic spring or a large space in the housing is required, which restricts pumping and increases the size of the pump. Also, it is difficult to pump highly viscous contents.

Second, since the compression spring contacts the contents, when the compression spring deteriorates, it is likely that the contents will be contaminated.

Third, since the opening and closing ball in the introducing hole in the lower end of the housing opens and closes the introducing hole due to changes in the pressure of the space inside the housing and the force of gravity, it is not possible to rapidly manage the pumping operation and to provide high sealing force. Therefore, some portion of the contents may leak out of the container during pumping and opening and closing operations are not rapidly performed such that pumping force is deteriorated.

In order to solve such problems, various structures have been developed. However, a hand-operated pump that provides satisfactory results has yet to be produced.

DISCLOSURE OF INVENTION

Technical Problem

Therefore, the present invention has been made in view of the above and/or other problems.

In other words, it is a first object of the present invention to provide a hand-operated pump in which a compression spring is provided outside a housing such that it is possible to reduce flow resistance of the contents, to increase the space of the inside of the housing, to prevent the contents from being contaminated by the spring, and to easily pump highly viscous contents. Also, the spring provided outside the housing is not separated even if a button is separated from the main body of the pump such that it is possible to easily assemble the pump, to easily modulize parts, and to prevent the pump from malfunctioning even in use.

It is another object of the present invention to provide a hand-operated pump in which an opening and closing member of a specific structure is used instead of the conventional opening and closing ball such that the hand-operated pump can rapidly manage the vertical movement of the stem during pumping and has high sealing force to obtain high sealing and pumping force.

Technical Solution

In order to achieve the above objects, there is provided a hand-operated pump including a button having a discharge hole, a housing constituting the external appearance of a pump, a closure coupled with the outer surface in the upper portion of the housing through a housing cap to mount the housing in a container, a stem having a horizontal passage communicated with the inner space of the housing and a vertical passage communicated with the horizontal passage and vertically moved while protruding from the upper end of the housing, the a shaft vertically moved along the inner surface of the housing cap while being coupled with the outer surface of the stem and connected to the lower end of the button, wherein a button is mounted in the upper end of a shaft, a housing cap for guiding the vertical movement of the shaft, for connecting the housing to the closure, and for sealing the inner space of the housing from the outside, a piston vertically moved along the inner wall of the housing while being mounted in the lower portion of the stem, a compression spring positioned between the button and the housing cap to provide restoring force to the shaft during pumping; and an opening and closing member positioned in the lower end of the inner space of the housing to open and close an introducing hole in the lower end of the housing during pumping.

According to the hand-operated pump having such a structure, the spring positioned between the housing cap and the button is compressed when the button is pressed in order to pump the contents. The contents in the inner space of the housing are discharged through the vertical passage of the stem to the discharge hole of the button. On the contrary, when the force applied to the button is removed, the restoring force of the spring is transmitted to the shaft such that the contents in the container are introduced into the inner space of the housing. Therefore, since the compression spring is not positioned on the flow passage of the contents while providing the restoring force for performing the pumping operation, the above-described advantages are provided.

Protrusions are preferably formed on the sides in the upper portion of the shaft and the compression spring is preferably mounted between the side protrusions and the housing cap. Therefore, even if the button drifts away from the shaft, the compression spring is still mounted in the main body of the pump. Therefore, it is possible to simplify the assembly of the pump, to easily modularize the parts, and to prevent the spring from being separated even if the button drifts away while in use. According to such a structure, in order to more tightly couple the shaft with the stem, the upper end of the stem is preferably harpoon-shaped and minute protrusions are preferably formed on the corresponding inner surface of the shaft such that the stem is coupled with the shaft by inserting the stem into the cylindrical structure of the shaft from below.

In order to rapidly manage the vertical movement of the stem and to provide high sealing force, the opening and closing member as a hollow member whose upper end is opened preferably has radial protrusions formed on the sides toward the outside a vertical extending portion is formed in the lower end of the stem. The vertical extending portion preferably moves while being attached to the inner surface of the hollow of the opening and closing member.

The materials of the elements of the present invention are not restricted and are preferably synthetic resin such as polypropylene and polyethylene such as high density polyethylene (HDPE), and linear low density polyethylene (LLDPE), and polyoxymethylene (POM). The compression spring is generally made of stainless steel and may be made of highly elastic plastic.

ADVANTAGEOUS EFFECTS

According to the present invention, there is provided a hand-operated pump in which a compression spring is provided outside a housing such that it is possible to reduce the flow resistance of the contents, to increase the space of the inside of the housing, to prevent the contents from being contaminated by the spring, and to easily pump highly viscous contents. Also, the spring provided outside the housing is not separated even if a button is separated from the main body of the pump such that it is possible to easily assemble the pump, to easily modularize parts, and to prevent the pump from malfunctioning even in use. Moreover, there is provided a hand-operated pump in which an opening and closing member of a specific structure is used instead of the conventional opening and closing ball such that the hand-operated pump can rapidly manage the vertical movement of the stem during pumping and has high sealing force to obtain high sealing and pumping force.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Hereinafter, a preferred embodiment of the present invention will be described in detail with reference to the attached drawings, but the scope of the present invention is not limited the description.

Figure 1:
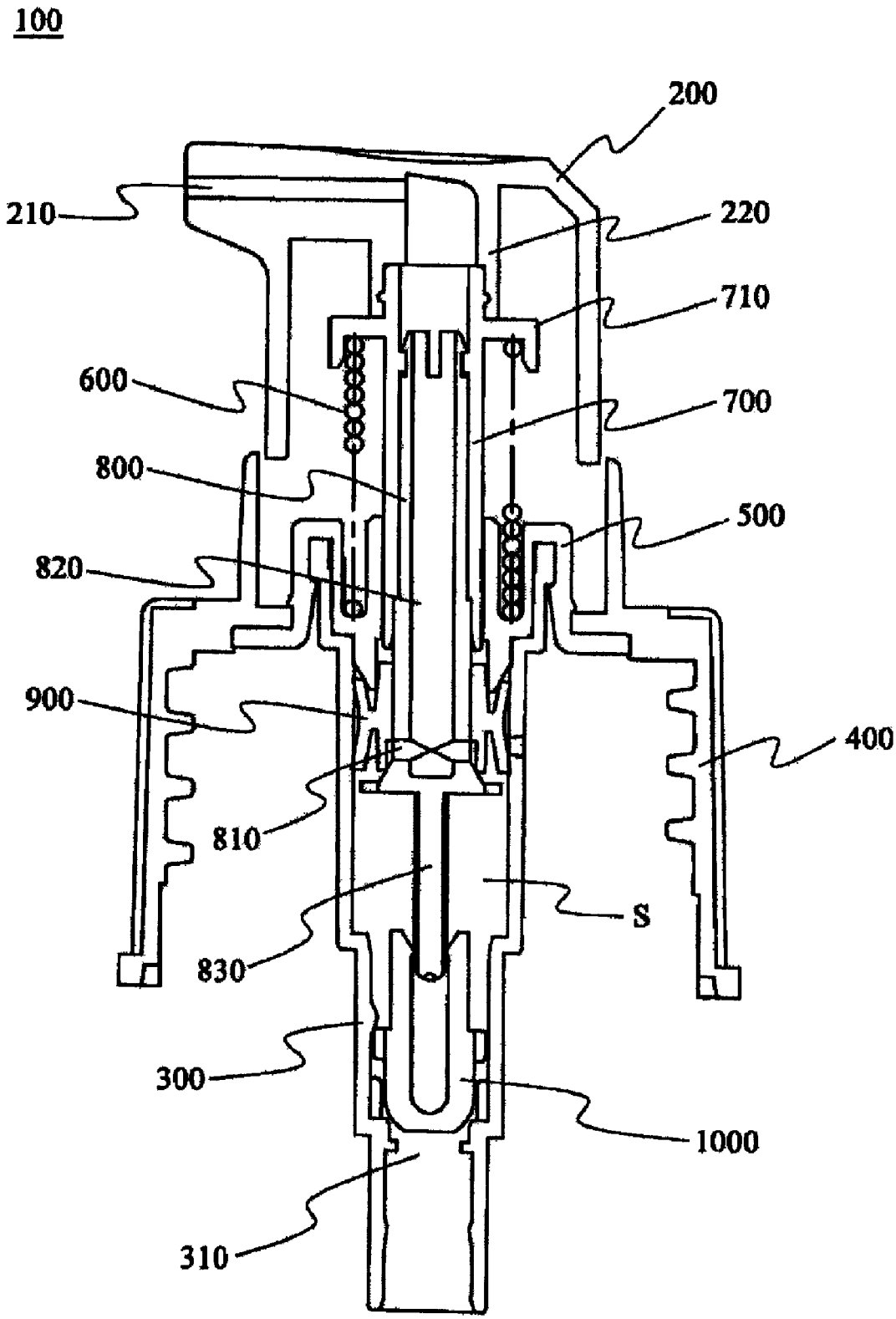
FIG. 1 is a vertical sectional view of a small hand-operated pump according to a preferred embodiment of the present invention.

FIG. 1 is a vertical sectional view of a small hand-operated pump according to the preferred embodiment of the present invention. A small hand-operated pump 100 shown in FIG. 1 includes a button 200 in the uppermost portion thereof. The button 200 includes a discharge hole 210 facing the side thereof. A fastener 220 combined with a shaft 700 is perpendicularly installed inside in the center of the button 200. The main external appearance of the pump 100 includes an approximately-cylindrical housing 300 having a diameter having multiple steps and a closure 400 for mounting the pump 100 in a container (not shown). A curved housing cap 500 combines the housing 300 and the closure 400 with each other. The housing cap 500 seals a housing inner space S from the outside and guides the vertical movement of the shaft 700. The compression spring 600 is mounted between side protrusions 710 formed in the upper end of the shaft 700 and the housing cap 500. Therefore, even if the button 200 is separated from the shaft 700, the compression spring 600 is stably fixed to the main body of the pump 100. A stem 800 combined with the inside of the cylindrical shaft 700 includes a horizontal passage 810 through which the contents in the inner space S of the housing are introduced, a vertical passage 820 connected to the horizontal passage 810, and a vertically extended part 830 in the lowermost end. The horizontal passage 810 is opened and closed by a piston 900 that moves vertically while being attached to the outer surface of the stem 800 and the inner surface of the housing 300. The inner space S of the housing is opened and closed by the operation of an opening and closing member 1000 positioned immediately above the introducing hole 310.

FIG. 1 illustrates the pump 100 in a state where no force is applied to the button 200 (hereinafter, referred to as a rest mode). The piston 900, due to the elasticity of the compression spring 600, seals the horizontal channel 810 of the stem 800. In rest mode, the opening and closing member 1000 seals the introducing hole 310 due to the pressure of the contents in the inner space S of the housing or, even if the opening and closing member 1000 does not seal the introducing hole 310, the introducing hole 310 is rapidly sealed in a pressing mode which will be described hereinafter.

Figure 2:
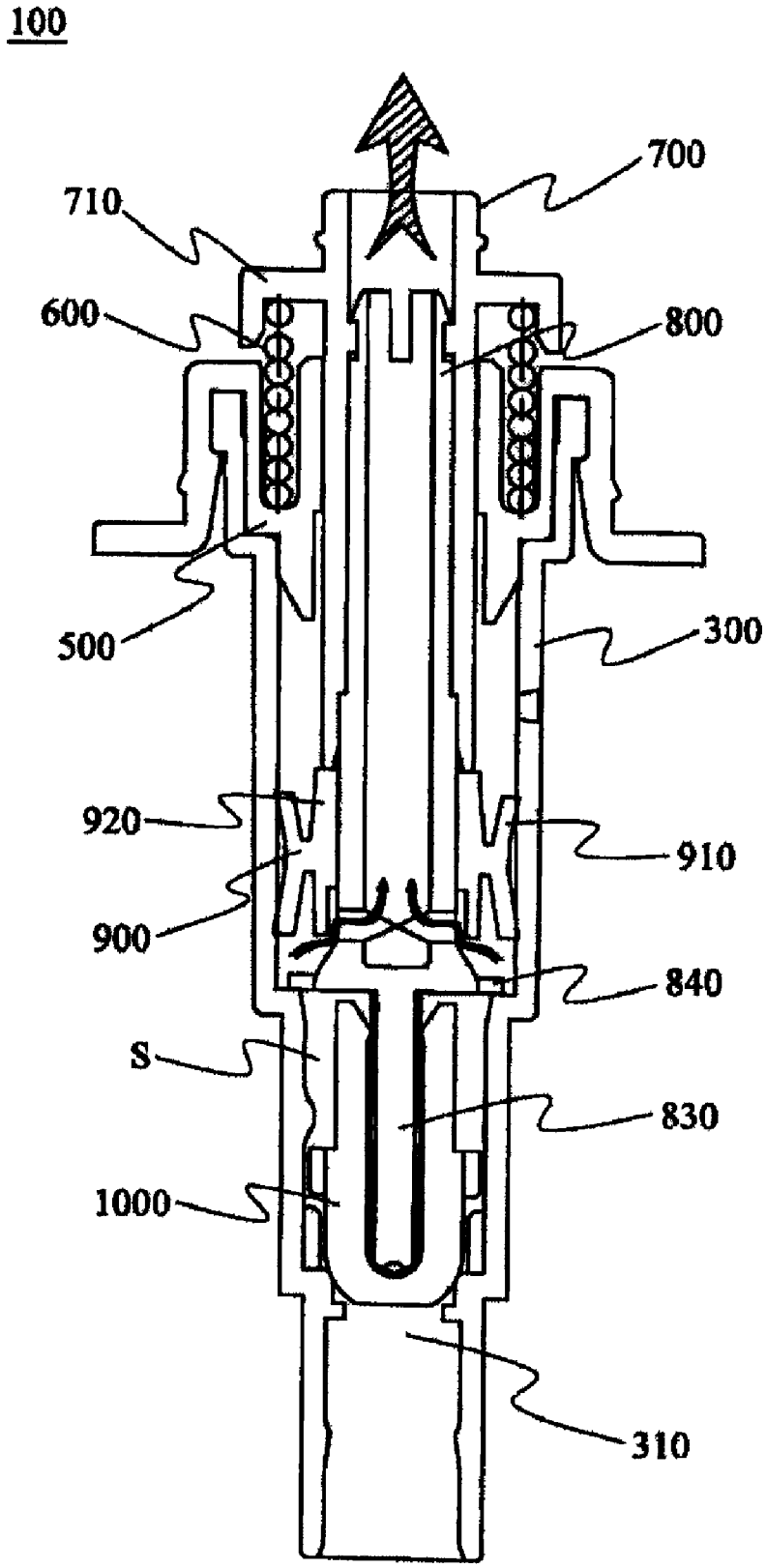
FIGS. 2 and 3 are views illustrating states in a pressing mode and a relaxing mode of the pump of FIG. 1.
Figure 3:
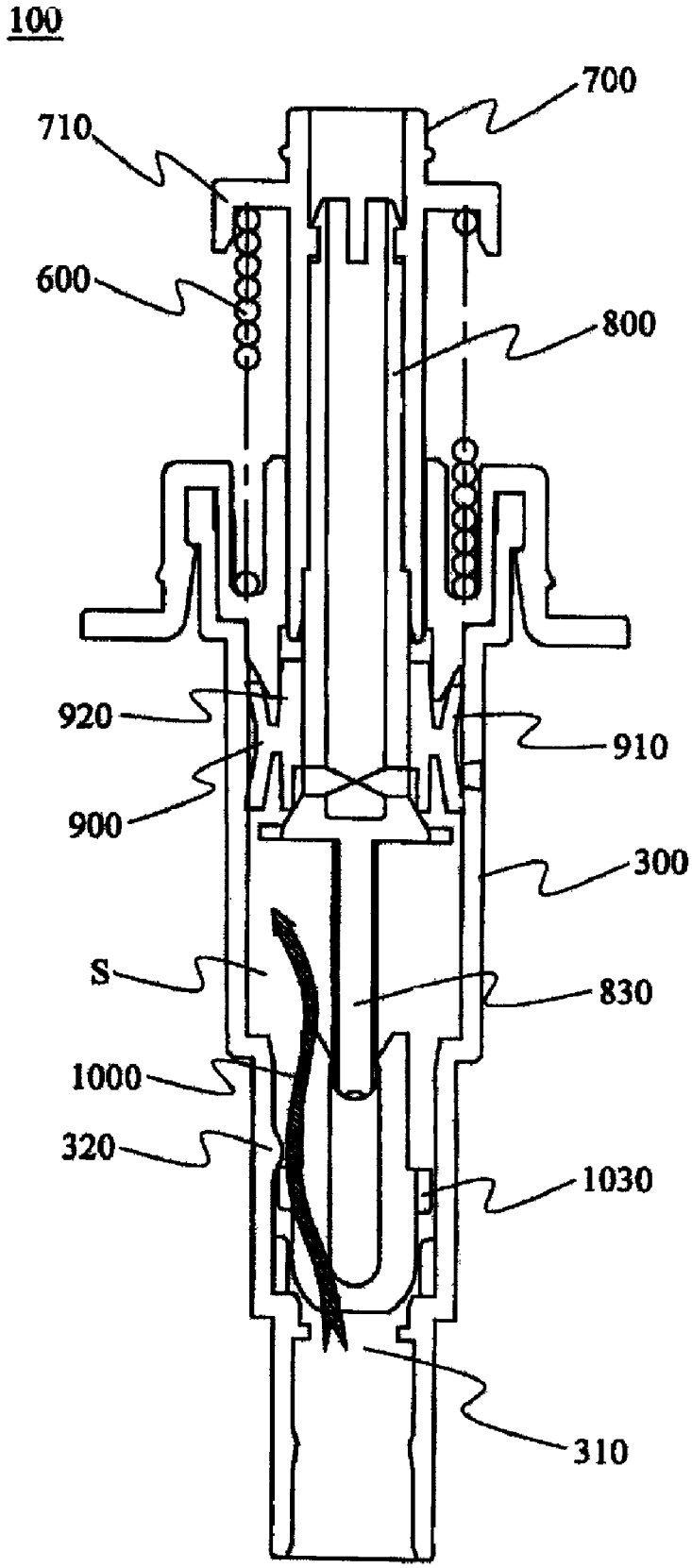

FIGS. 2 and 3 illustrate the pump 200 in a state where downward pressure is applied to the button (200 in FIG. 1) (hereinafter, referred to as a pressing mode) and in a state where such applied pressure is removed (hereinafter, referred to as a relaxing mode), respectively. For the sake of convenience, in FIG. 1, the button 200 and the closure 400 are not illustrated.

Referring to FIG. 2, in the pressing mode, the stem 800 simultaneously falls due to the falling of the shaft 700 and the compression spring 600 positioned between the side protrusions 710 of the shaft 700 and the housing cap 500 is compressed. Immediately after the stem 800 starts to fall, the vertically extended part 830 causes the opening and closing member 1000 to fall, immediately sealing the introducing hole 310. Therefore, the opening and closing member 1000, corresponding to the pumping operation, rapidly seals the introducing hole 310. On the other hand, since frictional force of the outer circumference 910 of the piston 900 with respect to the inner surface of the housing 300 is larger than the frictional force of an inner circumference 920 with respect to the outer surface of the stem 800, the piston 900 does not move until the lower end of the shaft 700 reaches the upper end of the outer circumference 910 of the piston 900. Therefore, the horizontal channel 810 is opened and the contents pressed in the inner space S of the housing are introduced into the horizontal passage 810 such that the contents rise along the vertical channel 820.

Referring to FIG. 3, the shaft 700 and the stem 800 simultaneously rise in the relaxing mode due to the restoring force of the compression spring 600. Due to the dual frictional forces of the outer circumference 910 and the inner circumference 920 as described above, the piston 900 does not move until the inner circumference 920 contacts the protruded portion in the lower end of the stem 800. Therefore, the stem 800 rises in a state where the horizontal passage 810 is sealed and the pressure of the inner space S of the housing is reduced. Reduction in the pressure is solved while the opening and closing member 1000 is opened such that the contents are introduced in the inner space S of the housing.

Hereinafter, components that constitute the pump 100 in FIG. 1 will be described in more detail with reference to FIGS. 4 to 9.

Figure 4:
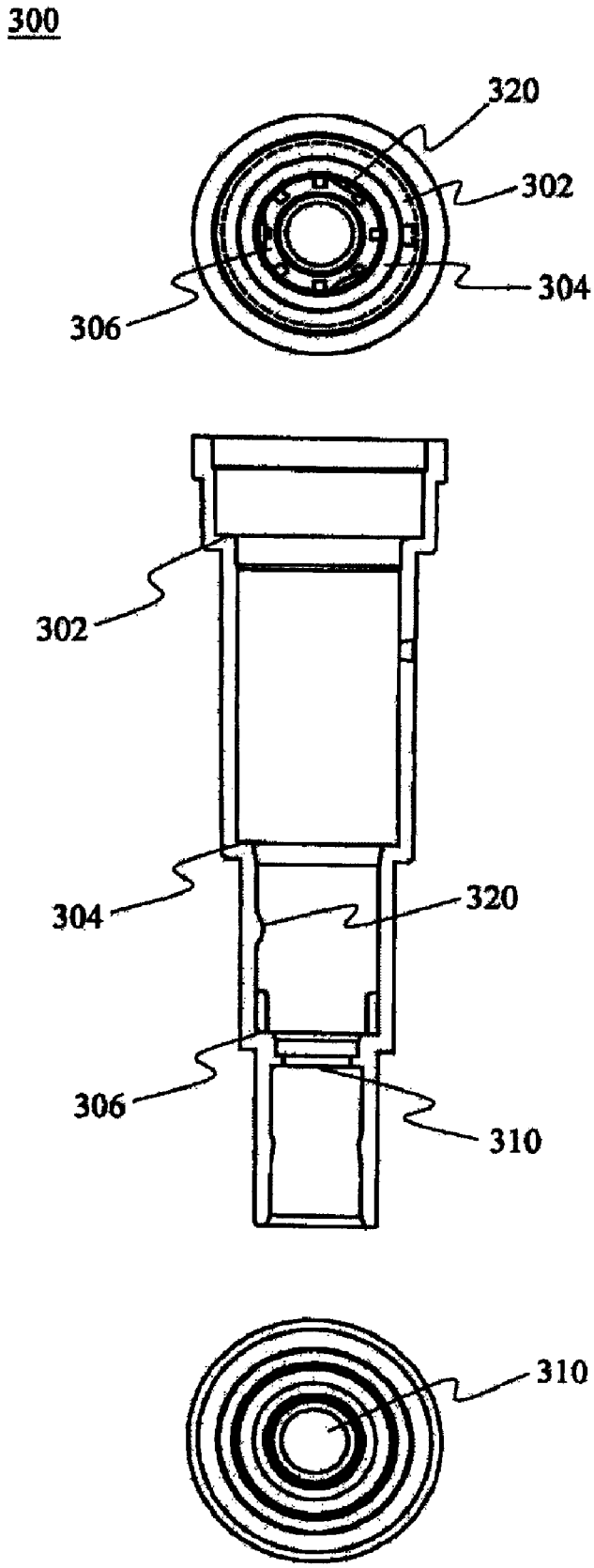
FIG. 4 illustrates a vertical sectional view, a plan view, and a bottom view of a housing that constitutes the pump of FIG. 1.

FIG. 4 illustrates a vertical sectional view, a plan view, and a bottom view of the housing 300. As shown in FIG. 4, the housing 300 is a cylindrical member having multiple steps. A first step 302 having the largest diameter is coupled with the housing cap 500 (See FIG. 1). A second step 304 is where a radial protrusion 840 (See FIG. 2) in the lower portion of the stem 800 reaches in the pressing mode. A third step 306 is attached to the lower end of the opening and closing member 1000 (See FIG. 1) in the pressing mode. In the upper inside above the third step 306, protrusions 320 discontinuously protrude. In the relaxing mode, the radial protrusions 1030 (See FIG. 3) of the opening and closing member 1000 are prevented from rising further due to the protrusions 320 on the side of the housing.

Figure 5:
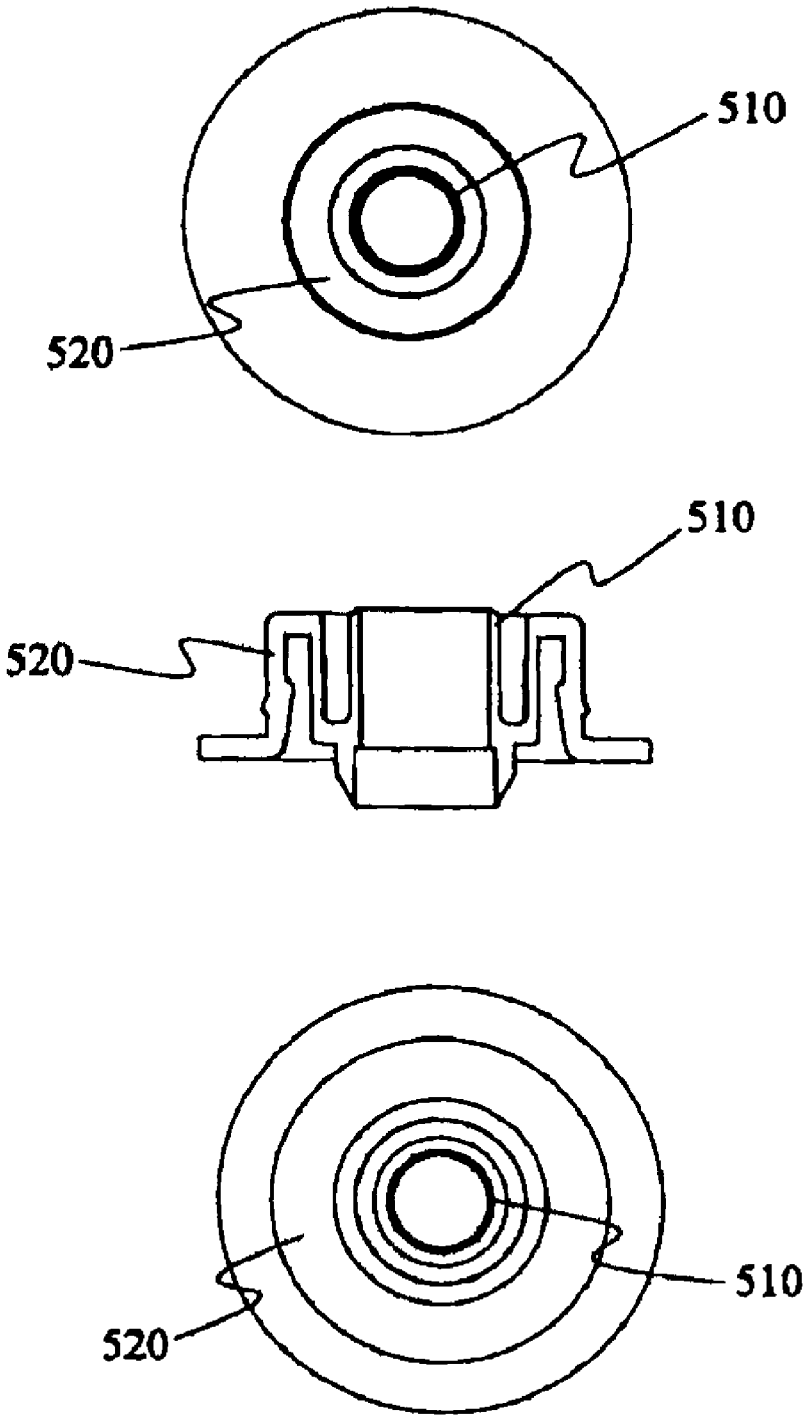
FIG. 5 illustrates a vertical sectional view, a plan view, and a bottom view of a housing cap that constitutes the pump of FIG. 1.

FIG. 5 illustrates a vertical sectional view, a plan view, and a bottom view of the housing cap 500. As shown in FIG. 5, in the housing cap 500, the portions that extend to the sides of the cylindrical main body are curved. A first curved portion 510 guides the vertical movement of the shaft 700 (See FIG. 1) attached to the inner surface thereof. A second curved portion 520 is combined with the upper end of the housing 300 (See FIG. 1) to be coupled with the closure 400 (See FIG. 1). The elasticity of such curved portions facilitates the guiding of the vertical movement of the shaft and the coupling with the housing.

Figure 6:
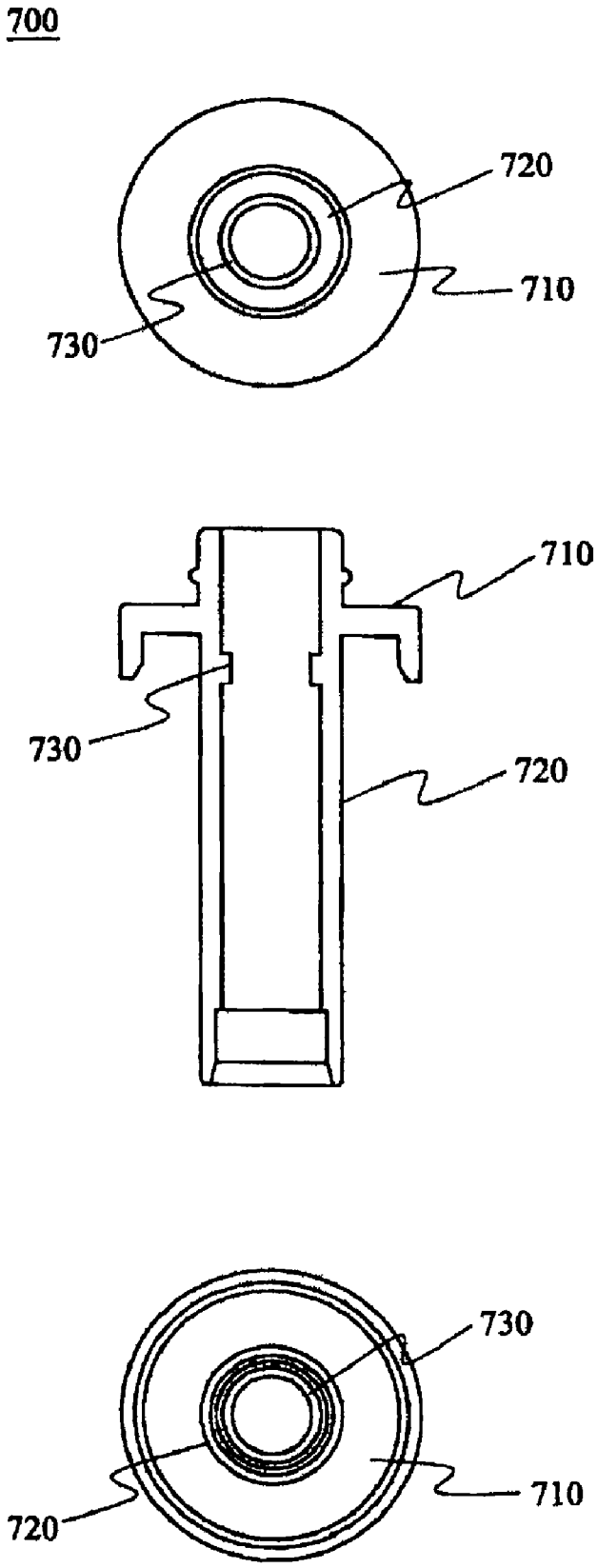
FIG. 6 illustrates a vertical sectional view, a plan view, and a bottom view of a shaft that constitutes the pump of FIG. 1.

FIG. 6 illustrates a vertical sectional view, a plan view, and a bottom view of the shaft 700. As illustrated in FIG. 6, the shaft 700 includes the cylindrical main body 720 and the side protrusions 710 formed on the outer surface in the upper outer portion thereof. The side protrusions 710 are engaged with the upper end of the compression spring 600 (See FIG. 1) to fix the compression spring to the main body of the pump. On the inner surface in the upper portion of the cylindrical main body 720, protrusions 730 are formed such that the harpoon-shaped upper end of the stem 800 (See FIG. 1) is combined therewith. Therefore, the cylindrical main body 720 is tightly coupled with the stem 800.

Figure 7:
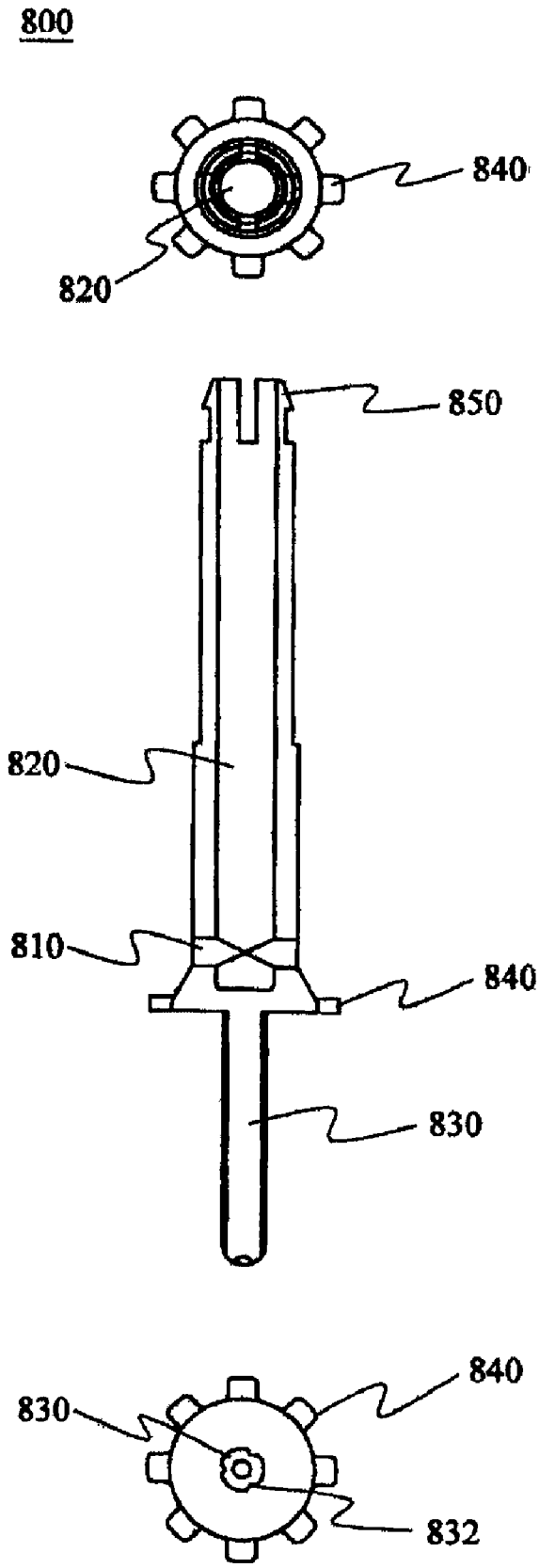
FIG. 7 illustrates a vertical sectional view, a plan view, and a bottom view of a stem that constitutes the pump of FIG. 1.

FIG. 7 illustrates a vertical sectional view, a plan view, and a bottom view of the stem 800. As shown in FIG. 7, the stem 800 includes the horizontal passage 810 connected to the inner space S (See FIG. 1) of the housing, a long vertical passage 820 connected to the discharge hole 210 of the button 200 (See FIG. 1) and the horizontal passage 810, radial protrusions 840 formed below the horizontal passage 810, and a longitudinal lower extending portion 830 connected to the opening and closing member 1000. The harpoon-shaped upper end 850 of the stem 600 can be tightly combined with the protrusions 730 on the inner surface of the shaft 700 (See FIG. 6) as described above due to the structural characteristic thereof. The lower extending portion 830 moves along the hollow portion of the opening and closing member 1000 (See FIG. 1) and has perpendicular minute grooves 832 such that the inside of the hollow portion can be communicated with the inner space S of the housing even in a state where the lower extending portion 830 is combined with the hollow portion in order to prevent the pressure of the inside of the hollow portion from changing.

Figure 8:
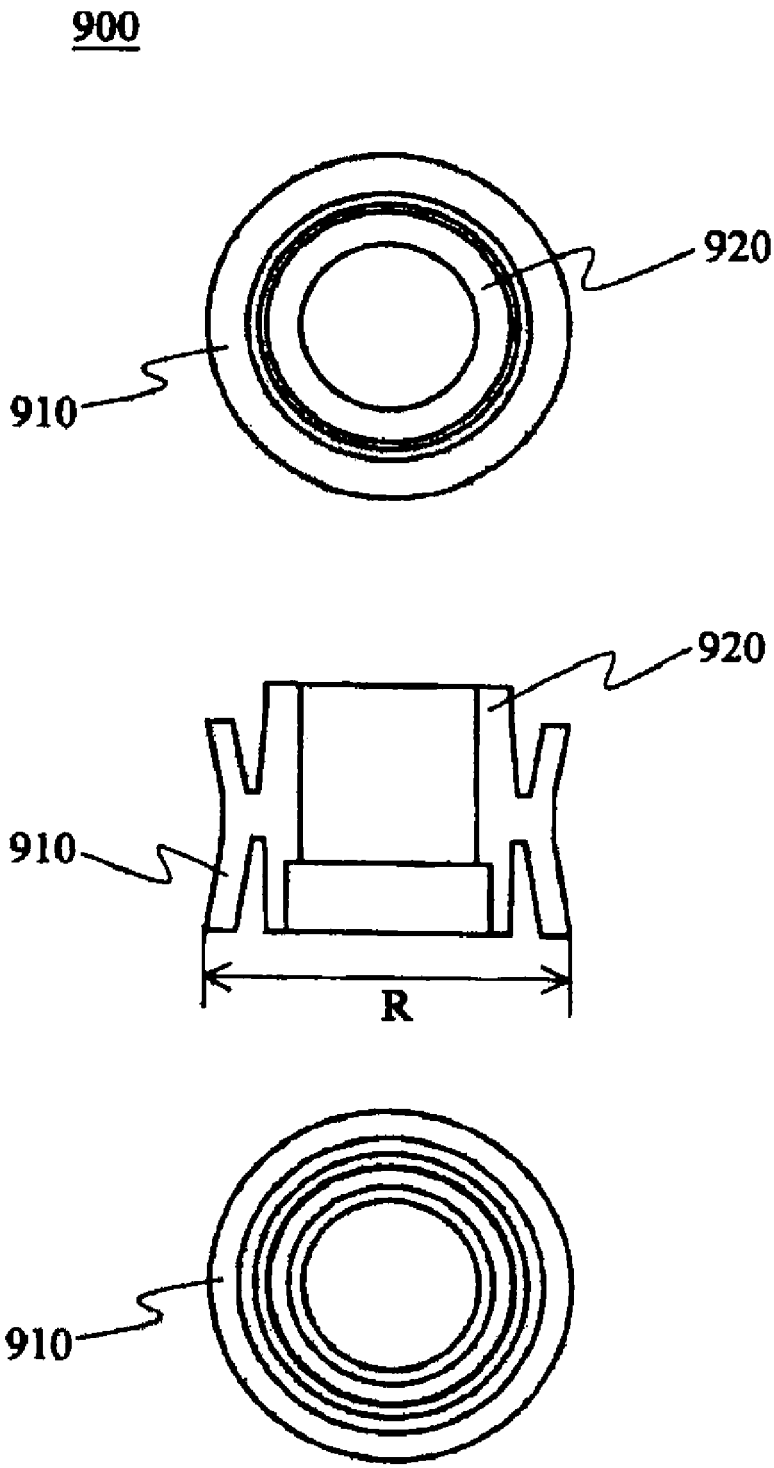
FIG. 8 illustrates a vertical sectional view, a plan view, and a bottom view of a piston that constitutes the pump of FIG. 1.

FIG. 8 illustrates a vertical sectional view, a plan view, and a bottom view of the piston 900. As shown in FIG. 8, the piston 900 includes the outer circumference 910 that contacts the inner surface of the housing 300 (See FIG. 1) and the inner circumference 920 that contacts the outer surface of the stem 800 (See FIG. 1). The outer diameter R of the outer circumference 910 is slightly larger than the inner diameter of the housing 300. The upper end of the outer circumference and the lower end of the outer circumference are curved toward the outside. Therefore, in order to insert the piston 900 into the inner surface of the housing 300, the upper end and the lower end of the outer circumference 910 are curved toward the inside to be adjusted to the diameter of the inner surface of the housing 300. Therefore, the frictional force of the outer circumference 910 with respect to the inner surface of the housing is larger than the frictional force of the inner circumference 920 with respect to the inner surface of the stem. Due to the dual frictional forces, as described above, during the pumping, the horizontal passage 810 of the stem 800 is opened and closed by the inner circumference 920 of the piston 900.

Figure 9:
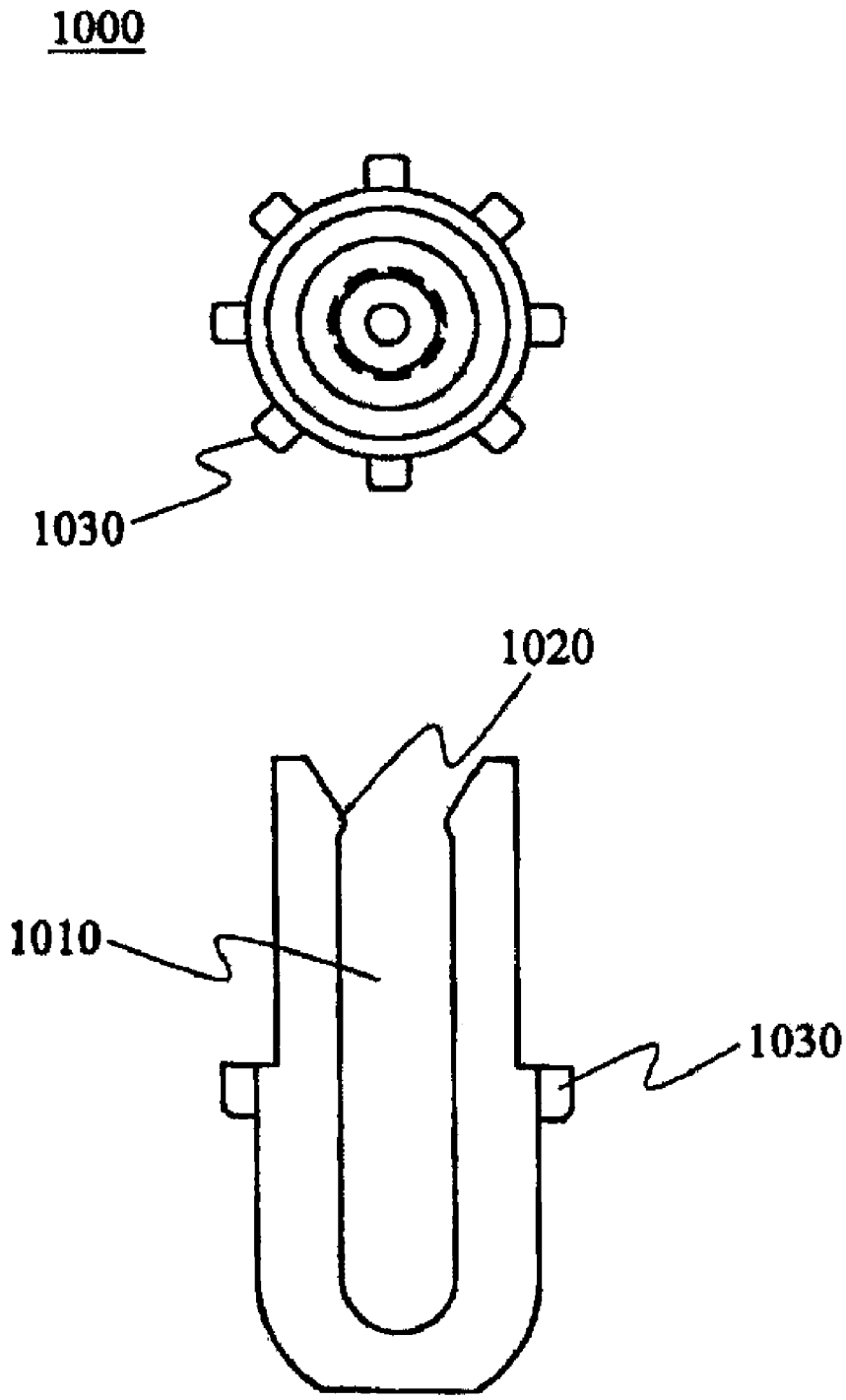
FIG. 9 illustrates a vertical sectional view and a plan view of an opening and closing member that constitutes the pump of FIG. 1.

FIG. 9 illustrates a vertical sectional view and a plan view of the opening and closing member 1000. As shown in FIG. 9, the opening and closing member 1000 has a hollow structure in which the upper portion thereof is opened. The sides of the lower end of the opening and closing member 1000 are rounded in order to increase the area attached to the receiving hole 310 (See FIG. 1) in the pressing mode. The lower extending portion 830 of the stem 800 (See FIG. 1) is inserted into a hollow portion 1010 and minute protrusions 1020 are formed on the inner sides in order to increase frictional force with respect to the lower extending portion 830. Therefore, the opening and closing member 1000 can rapidly manage the vertical movement of the stem 800. The rising of the opening and closing member 100 caused by the rising of the stem 800 is stopped when the radial protrusions 1030 formed on the sides reach the protrusions 320 of FIG. 4 on the sides of the inside of the housing and only the stem 800 continuously rises. At this time, the contents in a container (not shown) are received to the inner space S (See FIG. 3) of the housing through the gaps of the radial protrusions 1030.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A hand-operated pump comprising:

a button having a discharge hole;

a housing constituting the external appearance of a pump;

a closure coupled with an outer surface in an upper portion of the housing to mount the housing in a container;

a housing cap for connecting the housing to the closure, and for sealing an inner space of the housing from the outside;

a stem having a horizontal passage which communicates with the inner space of the housing and a vertical passage which communicates with the horizontal passage, wherein the stem vertically moves while protruding from the upper end of the housing;

a shaft connected to a lower end portion of the button, wherein the shaft vertically moves along the inner surface of the housing cap for guiding the vertical movement of the shaft, while being coupled with an outer surface of the stem, and the button is mounted in the upper end of the shaft;

a piston which vertically moves along an inner wall of the housing while being mounted in an lower portion of the stem;

a compression spring disposed between the button and the housing cap to provide restoring force to the shaft during pumping; and an opening and closing member disposed in the lower end of the inner space of the housing to open and close an introducing hole in the lower end of the housing during pumping, wherein a vertical extending portion is disposed in the lower end of the stem, wherein the opening and closing member has a hollow portion whose upper end is opened and has radial protrusions disposed on the outer side surface thereof toward the outside, and wherein the vertical extending portion moves while being attached to the inner surface of the hollow portion of the opening and closing member.

2. The hand-operated pump as set forth in claim 1, further comprising protrusions formed on the sides in the upper portion of the shaft, wherein the compression spring is mounted between the side protrusions and the housing cap.

3. The hand-operated pump as set forth in claim 1, wherein the upper end of the stem is harpoon-shaped and minute protrusions are formed on the corresponding inner surface of the shaft such that the stem is coupled with the shaft by inserting the stem into the cylindrical structure of the shaft from below.

* * * * *